US006778183B1

(12) United States Patent
Nair et al.

(10) Patent No.: US 6,778,183 B1
(45) Date of Patent: Aug. 17, 2004

(54) METHOD AND SYSTEM FOR ADAPTIVE COLOR AND CONTRAST FOR DISPLAY DEVICES

(75) Inventors: Hari Nair, Bangalore (IN); Neha Agrawal, Bangalore (IN); Saif Choudhary, Bangalore (IN); Ashish Neema, Bangalore (IN); Arun Johary, San Jose, CA (US)

(73) Assignee: Genesis Microchip Inc., Alviso, CA (US)

( * ) Notice: Subject to any disclaimer, the term of this patent is extended or adjusted under 35 U.S.C. 154(b) by 34 days.

(21) Appl. No.: 10/193,348

(22) Filed: Jul. 10, 2002

(51) Int. Cl.[7] ..... G09G 5/02

(52) U.S. Cl. ..... 345/589; 345/601; 345/606; 345/617

(58) Field of Search ..... 345/22, 72, 83, 345/88, 549, 589, 592–595, 597, 598, 600–610, 617, 690, FOR 108, 122, 169, 212; 348/34, 353, 365, 404.1, 424.2, 603, 673, 678, 686, FOR 120, 135, 141

(56) References Cited

U.S. PATENT DOCUMENTS 4,386,345 A * 5/1983 Narveson et al. ..... 345/22
4,430,665 A * 2/1984 Cochran ..... 348/627
4,774,580 A * 9/1988 Miyasako ..... 348/673
5,828,793 A * 10/1998 Mann ..... 382/284
5,940,544 A * 8/1999 Nako ..... 382/293
5,949,918 A * 9/1999 McCaffrey ..... 382/274
6,008,794 A * 12/1999 Ishii ..... 345/598
6,023,266 A * 2/2000 Eglit et al. ..... 345/555
6,172,718 B1 * 1/2001 Alvarez et al. ..... 348/625
6,239,782 B1 * 5/2001 Siegel ..... 345/690
6,351,558 B1 * 2/2002 Kuwata ..... 382/168
6,396,504 B1 * 5/2002 Yung et al. ..... 345/589
6,400,989 B1 * 6/2002 Eckmiller ..... 607/54
6,417,891 B1 * 7/2002 Cacciatore et al. ..... 348/649

FOREIGN PATENT DOCUMENTS

JP 2001134235 A * 11/1999 ..... G09G/3/36

* cited by examiner

*Primary Examiner*—Matthew C. Bella
*Assistant Examiner*—G. F. Cunningham
(74) *Attorney, Agent, or Firm*—Beyer Weaver & Thomas, LLP

(57) ABSTRACT

A method and apparatus that allows a display device to adaptively and automatically control display contrast and color is disclosed. The method and system in accordance with the present invention can be described by the following sequential process:

1. Separating an input image data value into its luma and chroma components.
2. Collecting the luma distribution data over the entire image or a specified window.
3. Analyzing the luma distribution.
4. Generating an appropriate contrast control response that modifies the input luma component to generate an output luma component, on a pixel by pixel basis.
5. Analyzing the input luma component and the output luma component, and an input chroma component, to generate an appropriate modification for the chroma component, on a pixel by pixel basis.

56 Claims, 8 Drawing Sheets a - No change in output (Avg brightness $B_A$)
b - Increased contrast, Increased brightness (Avg brightness $B_B$)
c - Decreased contrast, Decreased brightness(Avg brightness $B_C$)

Standard contrast adjustment a - No change in output (Avg brightness $B_A$)
b - Increased contrast, Increased brightness (Avg brightness $B_B$)
c - Decreased contrast, Decreased brightness(Avg brightness $B_C$)

Standard contrast adjustment

Recovering full luma dynamic range ("Snapping")

Dark image template transfer function

Mid-tone image template transfer function

Bright image template transfer function

Snapping the blended template transfer functions

Representative hardware implementation data path

METHOD AND SYSTEM FOR ADAPTIVE COLOR AND CONTRAST FOR DISPLAY DEVICES

FIELD OF THE INVENTION

The present invention relates generally to display devices and particularly to a system and method that provides adaptive color and contrast for a display device.

BACKGROUND OF THE INVENTION

A display device renders input data as a two-dimensional image in color or grayscale. The input data may be graphical in nature. An example of such a device is a PC display monitor. The input data may be a video signal. An example of such a device is a TV or video monitor. The input data may be a combination of graphics and embedded video. An example of such a device is a PC display monitor displaying graphics with one or applications displaying video in a window, or a PC/TV display device with two or more input ports displaying graphics or fill-screen video or a combination of graphics and video, e.g. Picture-in-Picture.

A viewer typically manually controls the color and contrast of a display device. The issue with manual control is that it does not result in optimal display quality for all possible input data. For example, setting the contrast control to increase the contrast of a washed out image will result in over-contrasty images for a normal image. Decreasing the color saturation setting for a highly saturated image would be optimal, but if the input changes to a de-saturated image, this setting would now be sub-optimal. It is not feasible or convenient for a viewer to continuously change display settings to adapt to the nature of the input image, particularly when the input is a video sequence.

Another problem with manual control of contrast and color is that it is not sensitive to the nature of the input data. Manual contrast control applies a multiplicative factor to the input luma component. This is shown graphically in FIG. 1. Due to the finite dynamic range of luma values, increasing the contrast of a dark image in order to be able to see the shadow details results in loss of information in the bright highlights. The multiplicative nature of this control also implies that there is no possibility of increasing the contrast of a predominantly bright image.

Accordingly, what is needed is a system and method to address the above-identified problems. The present invention addresses such a need.

SUMMARY OF THE INVENTION

A method and apparatus that allows a display device to adaptively and automatically control display contrast and color is disclosed. The method and system in accordance with the present invention can be described by the following sequential process:

1. Separating an input image data value into its luma and chroma components.
2. Collecting the luma distribution data over the entire image or a specified window.
3. Analyzing the luma distribution.
4. Generating an appropriate contrast control response that modifies the input luma component to generate an output luma component, on a pixel by pixel basis.
5. Analyzing the input luma component and the output luma component, and an input chroma component, to generate an appropriate modification for the chroma component, on a pixel by pixel basis.

DETAILED DESCRIPTION

The present invention relates generally to display devices and particularly to a system and method that provides adaptive color and contrast for a display device. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Definitions

Digital Display Device: an electronic image display device that uses digitized (sampled and quantized) image data. The input data itself may be analog in nature, and digitized within the device for display on a digital display such as an LCD, OLED or plasma panel. Alternatively, the input data itself may be digital in nature and finally displayed on an analog display such as a CRT.

Pixel: the smallest discrete region on a digital display device that can be addressed for display.

Luma: the component of the input image data value that is correlated to the perceived intensity of the displayed data value.

Chroma: the component of the input image data value that is correlated to the perceived color of the displayed data value. Hue and saturation are two commonly used color perceptions that together define the chroma value.

A system and method in accordance with the present invention continuously analyzes the input data and responding by manipulating the color and contrast of the display device. The system is both adaptive and automatic. The term adaptive is used to signify that the proposed solution continuously generates an appropriate response based on an analysis of the input data. The term automatic is used to signify that there is no viewer interaction required for this process.

The apparatus in accordance with the present invention may be hardware, software, or a combination of hardware and software. An example of a pure hardware solution would be an FPGA or ASIC design. An example of a hardware and software implementation would be a DSP and embedded firmware.

Figure 1:
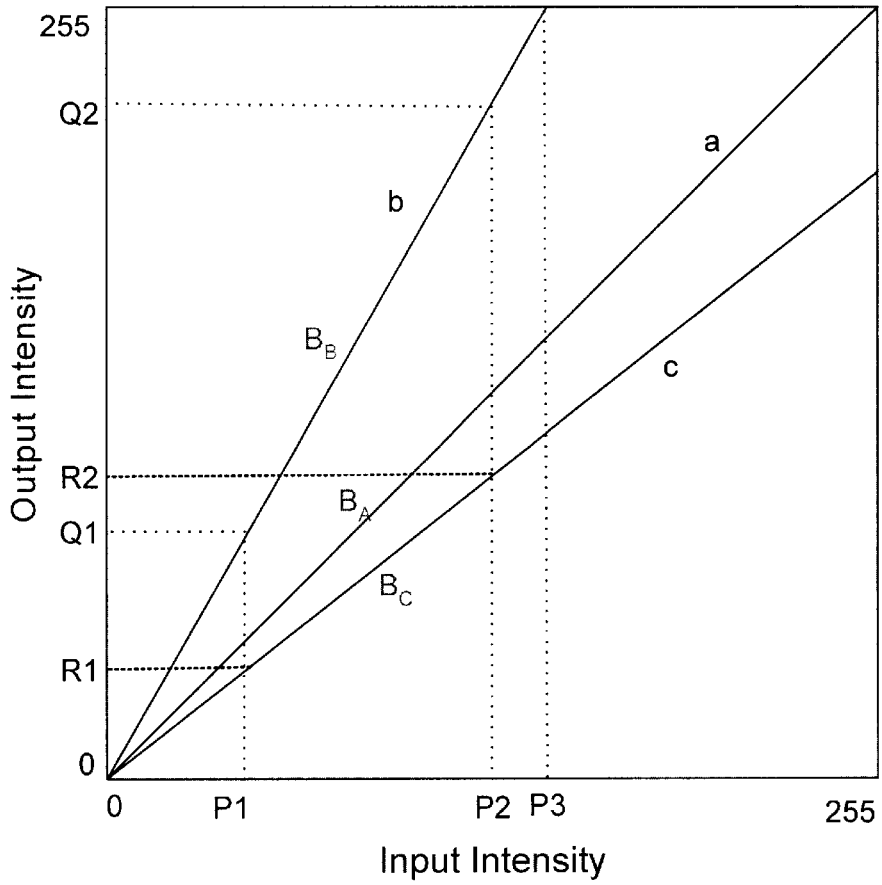
FIG. 1 illustrates a standard contrast adjustment.
Figure 2:
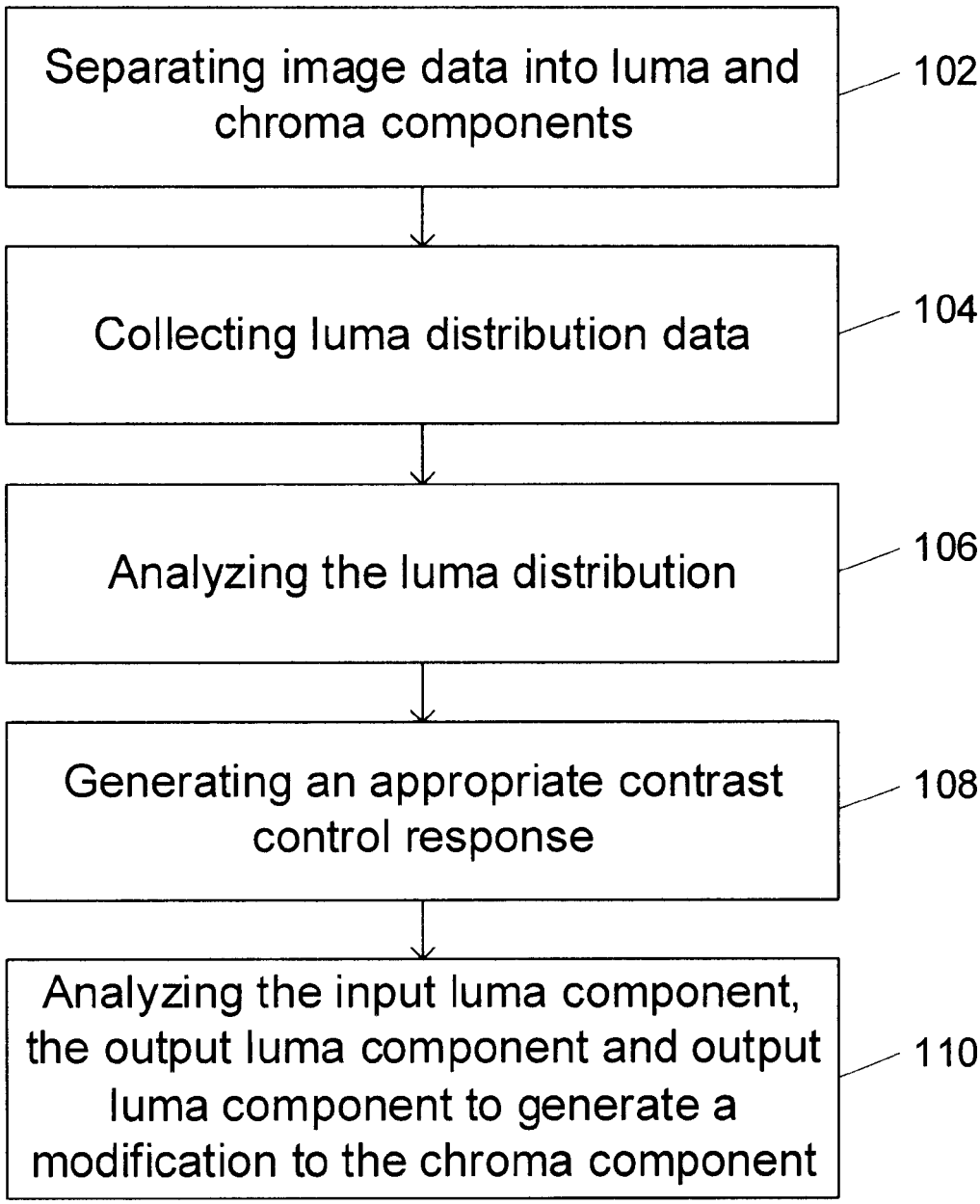
FIG. 2 is a flow chart illustrating adaptive color contrast in accordance with the present invention.

The method and system in accordance with the present invention is described in a preferred embodiment by the below-identified sequential steps in conjunction with FIG. 2. FIG. 2 is a flow chart illustrating adaptive color contrast in accordance with the present invention.

1. Separating an input image data value into its luma and chroma components, via step 103.
2. Collecting the luma distribution data over the entire image or a specified window, via step 104.
3. Analyzing the luma distribution, via step 106.
4. Generating an appropriate contrast control response that modifies the input luma component to generate an output luma component, on a pixel by pixel basis, via step 108.
5. Analyzing the input luma component and the output luma component, and an input chroma component, to generate an appropriate modification for the chroma component, on a pixel by pixel basis, via step 110.

Each of the steps will be described in detail hereinbelow.

1. Separating Input Data Into Luma and Chroma Components (Step 102).

If the input data is already formatted as luma+chroma, this process is not required. If the input is in some other format, such as RGB, this process will generate the luma and chroma components.

2. Collecting Luma Distribution Data (Step 104).

This process divides the range of luma values into a number of overlapping bands and counts the number of input luma data values that fall within each of these bands, over the entire image or a specified window in the image. An image window will normally be specified when the desired control response needs to be confined to a window on the screen. This window could for example be a Picture-In-Picture video window, or an embedded video window within a graphics screen.

At the end of this process, the luma distribution is defined by a set of band indices and their corresponding counts. This statistical distribution table is the luma histogram.

In addition, the darkest and brightest luma data values found are also stored. These values can be either determined by the actual minimum and maximum values found in the image, or from a cumulative analysis of the luma histogram. For example, the minimum luma could be determined as the value beyond which 99% of the image luma values are found. The maximum luma could be determined as the value below which 99% of the image luma values are found.

3. Analyzing Luma Distribution Data (Step 106).

If the input data luma range is very evenly distributed over the range from black to white, this will reflect in the count values being approximately equal. If the input data luma values are clustered around certain portions of the entire range, this will reflect in different count values for different bands.

For example, a relatively high count in the lower bands corresponds to a predominantly dark image. A relatively high count in the upper bands corresponds to a predominantly bright image. A relatively high count in the middle bands corresponds to a mid-tone image. For each of these image categories, it is possible to pre-define an optimal contrast control response.

Figure 3:
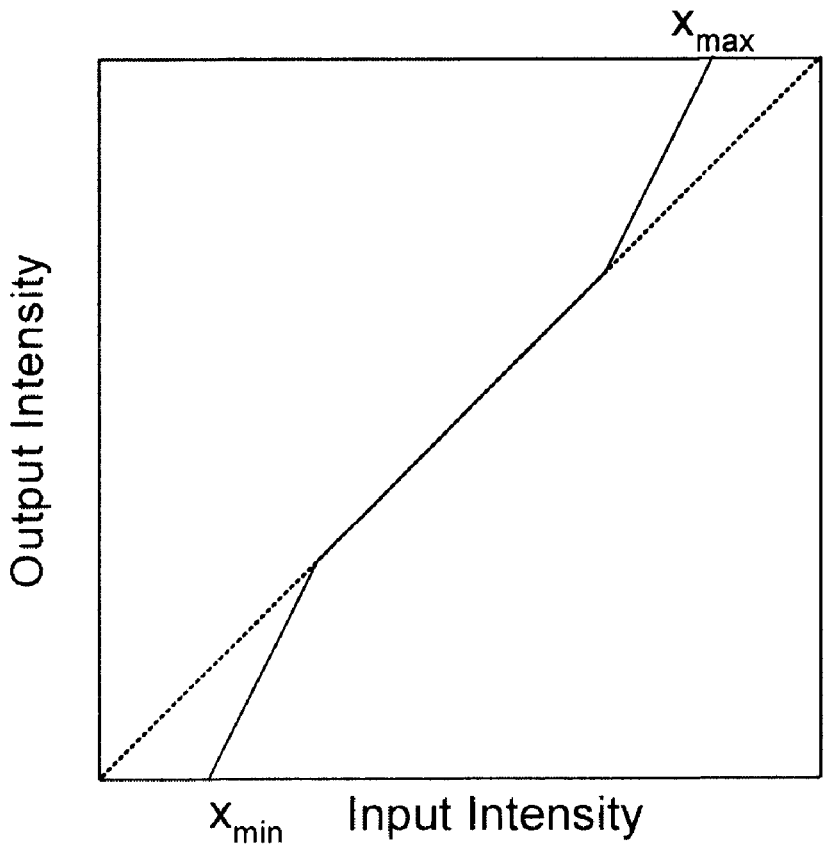
FIG. 3 illustrates a "snapping" process.

The darkest and brightest luma data values indicate the dynamic range of the input luma data. If this is less than the available dynamic range available, it is desirable to remap the luma values to fully utilize the available dynamic range for maximum visual quality. For example, assuming a normalized luma range of 0 to 1, if the darkest luma value is 0.2 and the brightest luma value is 0.9, it is possible to remap the input range of 0.2–0.9 to the range 0.0–1.0. This "snapping" process is shown in FIG. 3.

4. Generating Appropriate Contrast Control Response (Step 108).

Figure 4:
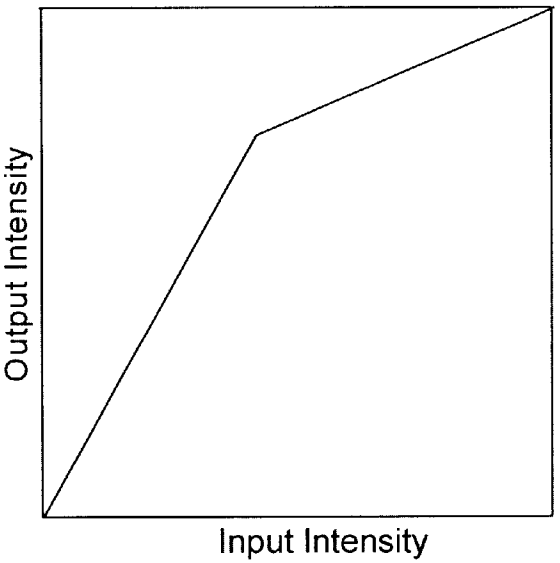
FIG. 4 illustrates the dark range case and its transfer function.
Figure 4:
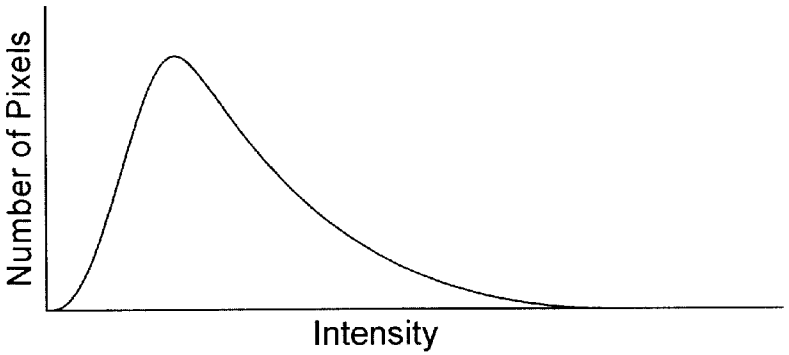

This method specifies an optimal contrast control response for a limited subset of the universe of possible luma distributions. For example, if three luma bands are used for analysis, it is possible to specify three control responses that are optimal for the following cases:

Dark image: relatively high band count in first band, compared to other two bands Mid-tone image: relatively high band count in middle band, compared to other two bands Bright image: relatively high band count in last band, compared to other two bands For the dark image case, a suitable contrast control response expands the dark image pixel dynamic range, and compresses the bright pixel dynamic range. FIG. 4 illustrates the dark range case and its transfer function.

Figure 5:
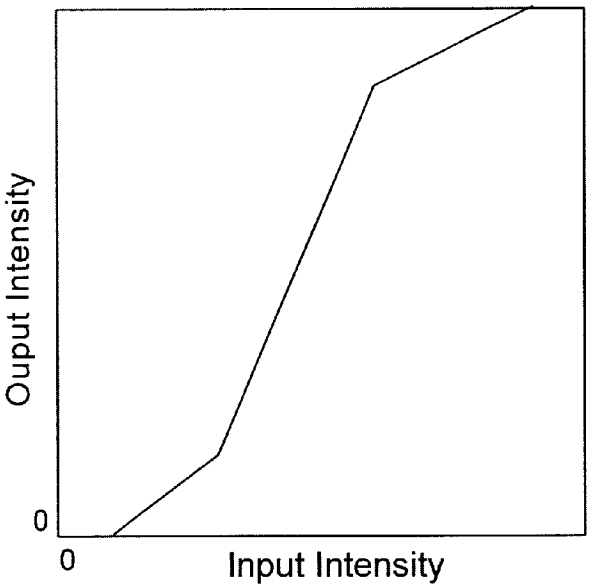
FIG. 5 illustrates the mid-tone range case and its transfer function.
Figure 5:
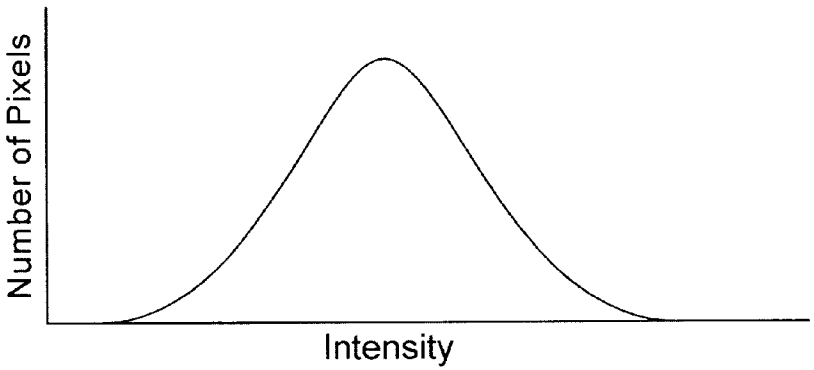

For the mid-tone image case, a suitable contrast control response expands the mid-tone dynamic range, and compresses the dark and bright image dynamic range. FIG. 5 illustrates the mid-tone range case and its transfer function.

Figure 6:
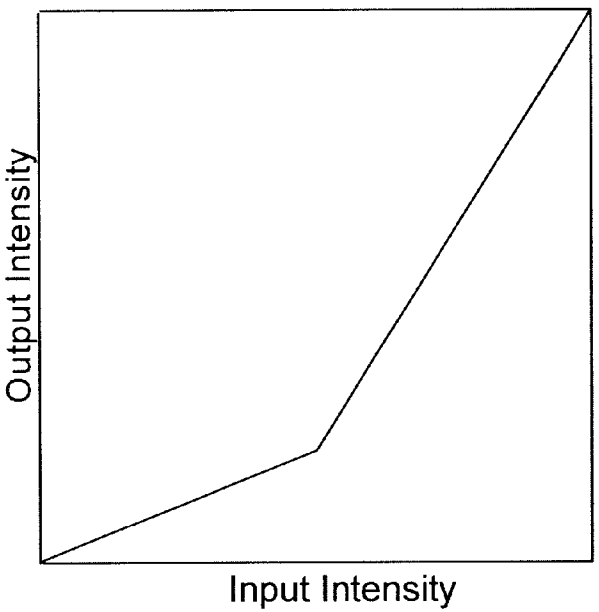
FIG. 6 illustrates the bright range case and its transfer function.
Figure 6:
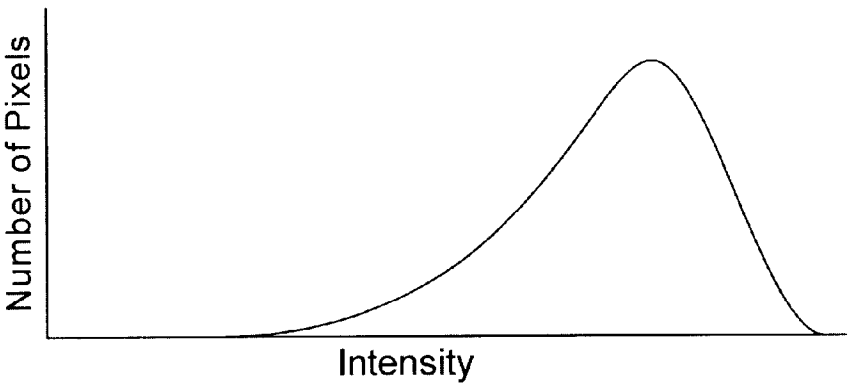

For the bright image case, a suitable contrast control response expands the bright pixel dynamic range and compresses the dark pixel dynamic range. FIG. 6 illustrates the bright range case and its transfer function.

These control responses are user definable so that any desired contrast control can be applied.

For an actual input luma distribution, the relative luma counts in the different bands are used to determine how well the actual luma distribution correlates to the chosen subset of luma distributions.

This method then blends the predefined control responses for the subset of luma distributions using the relative luma counts as a blending weight. For example if the actual luma counts are relatively high in both dark and mid-tone bands and low in the bright region, the blending process will generate a control response that is predominantly a blend of the appropriate control responses for dark images and mid-tone images.

Figure 7:
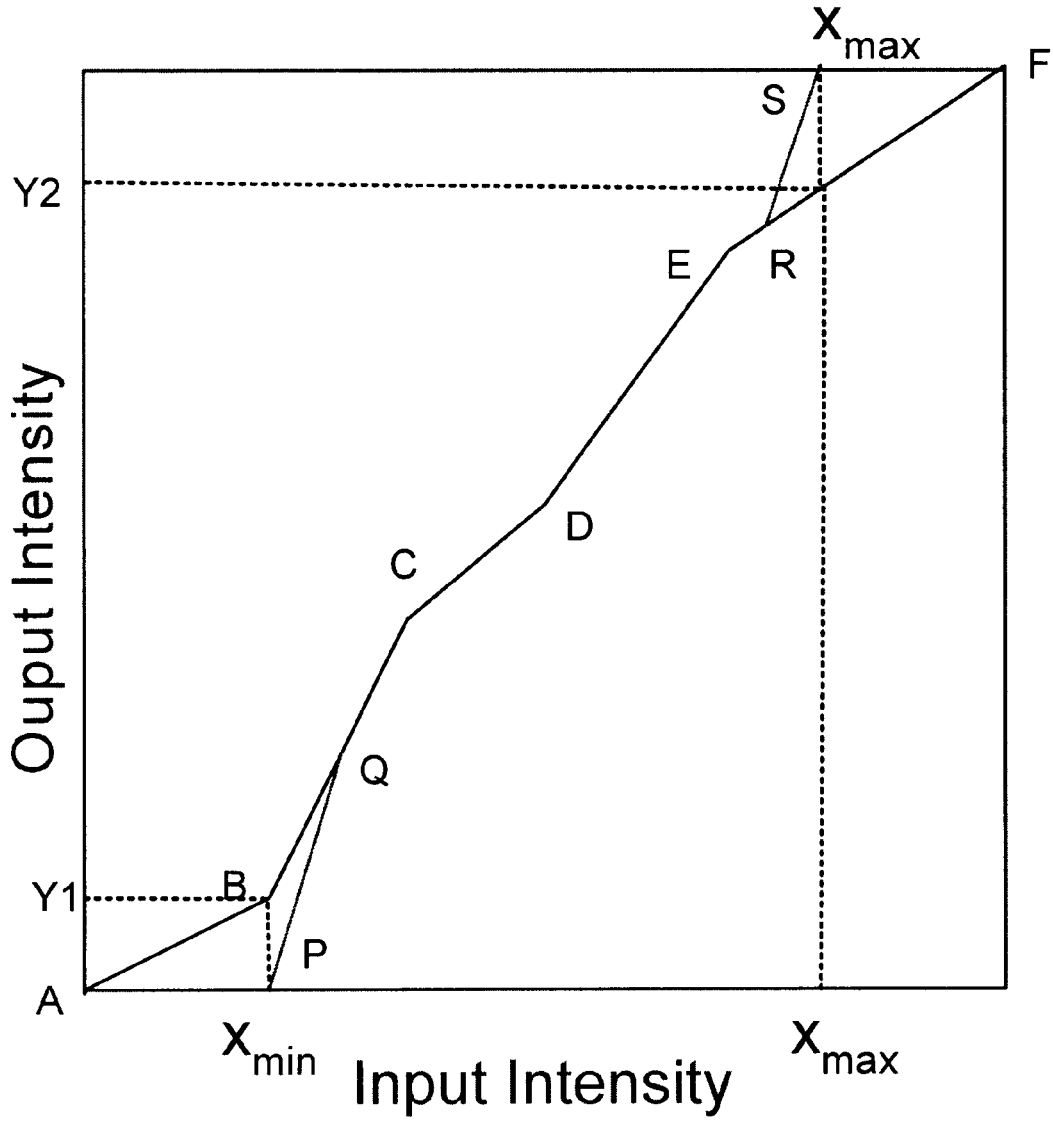
FIG. 7 illustrates modifying the blended contrast control response so that display dynamic range is fully utilized.

Finally, the computed darkest (Xmin) and brightest (Xmax) luma values are used to modify the blended contrast control response so that display dynamic range is fully utilized. This is shown in FIG. 7.

5. Analyzing Modified Luma Followed by Generation of Non-linear Chroma Correction Factor (Step 110).

This method analyzes on a pixel by pixel basis the incoming luma value and outgoing modified luma value, and generates an appropriate adjustment for the chroma component. The chroma adjustment maintains or enhances the perceived color saturation of the picture when the contrast has been increased.

The chroma correction applied is determined by the difference between the luma output and the luma input to the luma LUT and is non-linear. If the incoming pixel already is highly saturated, the amount of additional chroma correction is decreased.

Figure 8:
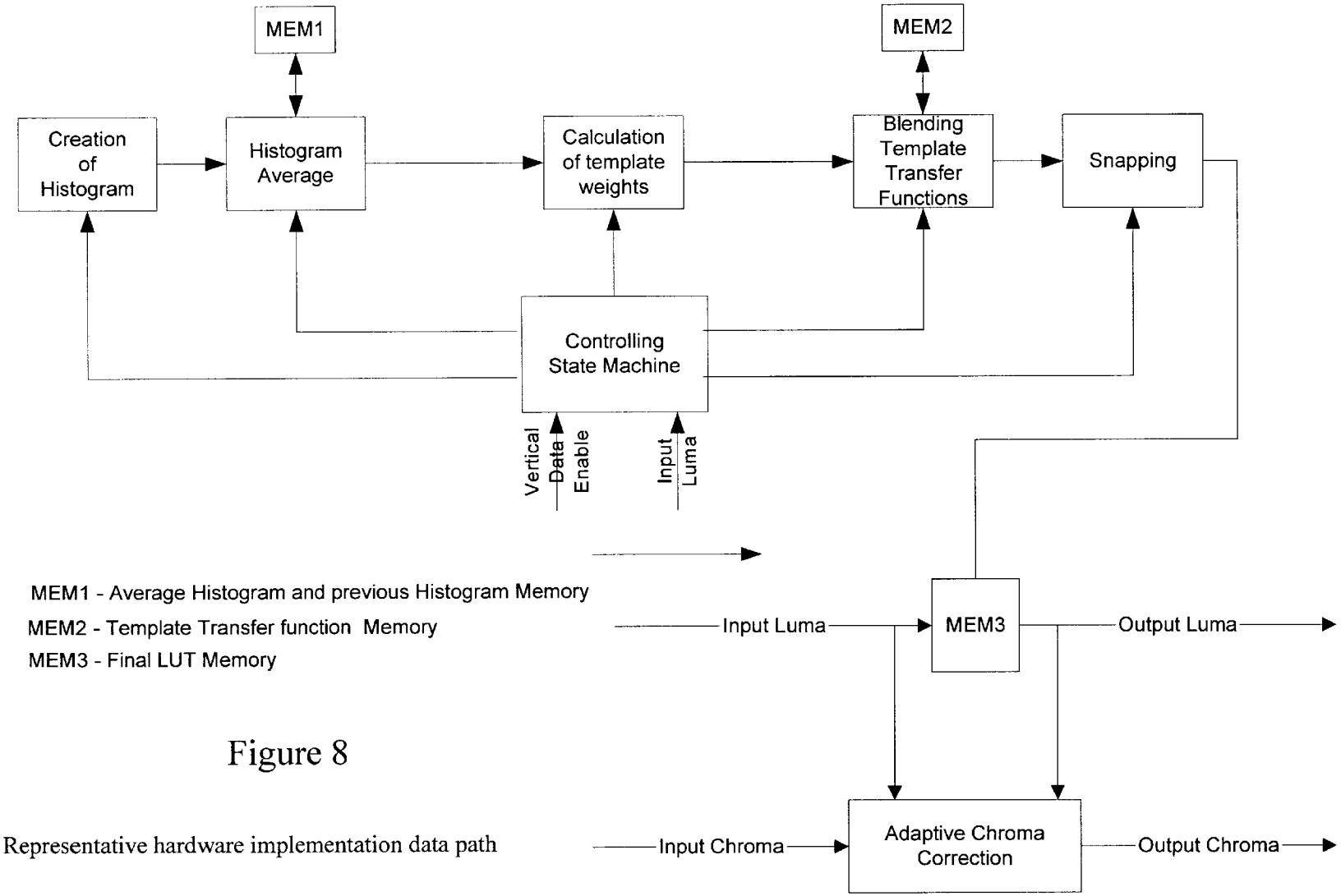
FIG. 8 shows a representative hardware data path diagram.

A representative hardware data path diagram 200 is shown in FIG. 8. In this figure, a controlling state machine 202, receives a vertical data enable signal and an input luma signal. The state machine 202 controls a creation of histogram black 204, a histogram average 206, template weight calculator 208, a template transfer function block 210 and a snapping function block 212. Memory 214 stores average histogram and the previous histogram. Memory 216 stores the template transfer function.

The snapping function block 212 provides final blended transfer function to memory 218. The memory receives input luma and provides an output luma. The input luma, output and the input chroma is provided to the adaptive chroma correction block 220. The adaptive chroma correction block provides the output chroma.

In this system, the collection of the current image histogram is performed during the active frame which is signaled, for example, by the vertical data enable signal at logic 1. When the vertical inactive period (blanking) starts, the histogram is averaged if necessary with previous image histograms. Then the template transfer function weights are calculated and the template transfer functions are blended using these weights. Finally the snapping operation is done on the blended output to recover the full dynamic range and the new contrast transfer function is written to the luma LUT memory. This new lookup table is used for the next image frame.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A method for controlling a display device comprising:

automatically and adaptively controlling contrast and color of the device in which user defined contrast control responses are blended using a combination of interpolation and non-linear methods such as thresholding, wherein the final blended control response is stored in a memory or look-up table, and wherein the blended control response is read from the memory during active display time and the analysis data (histogram) and predefined control responses are read during the display inactive time.

2. The method of claim 1, further comprises:

analyzing the pixel luma distribution, by collection and analysis of pixel luma distribution using multiple bands; and generating of a luma and chroma control response.

3. The method of claim 2 in which the multiple bands include overlapping bands.

4. The method of claim 3 that collects pixel luma distribution information using bin counters for each band.

5. The method of claim 4 in which the collection of pixel luma distribution information is limited to a user-definable region in the display.

6. The method of claim 1 in which the application of automatic and adaptive contrast and color control is to a user-definable region in the display.

7. The method of claim 4 in which user definable sensitivity to rate of change of image content is generated by averaging the collected pixel luma distribution data over a user-defined number of frames.

8. The method of claim 2 wherein the luma and chroma control response is based on user-defined inputs that could be a finite subset of all possible control responses.

9. The method of claim 1 in which the user defined contrast control responses are specified by lookup tables.

10. The method of claim 9 in which the user defined contrast control luma lookup tables are specified using base value and incremental slope.

11. The method of claim 10 in which an optimal contrast control response is generated by analysis of the actual luma distribution followed by blending of user defined contrast control responses.

12. The method of claim 1 in which blending weights are generated using relative luma distribution values or generated by scaling the luma band bin counters.

13. The method of claim 12 in which user defined contrast control responses are blended using interpolation and the generated blending weights.

14. The method of claim 1 in which user defined contrast control responses are blended using non-linear methods such as thresholding.

15. The method of claim 1 in which the input pixel dynamic range is mapped to the display or user-defined dynamic range.

16. The method of claim 1 in which the blended luma control response is modified using the minimum input luma value and maximum input luma value.

17. The method of claim 1 in which a chroma adjustment factor is generated based on analysis of the difference between the input luma value and the output luma value, in order to maintain or enhance perceived color saturation.

18. The method of claim 1 in which a non-linear chroma adjustment factor is generated based on analysis of the difference between input luma and output luma.

19. The method of claim 1 in which a chroma adjustment offset is generated that is added to the input chroma value.

20. The method of claim 19 in which RGB, YUV, YCrCb, YPrPb or any other color domain are utilized.

21. The method of claim 20 in which analog or digital displays are utilized.

22. The method of claim 1 in which previous frame luma distribution data during the vertical active interval is collected, and then predicted contrast processing functions are generated for the next image frame during the vertical retrace interval.

23. The method of claim 2 wherein the analysis data (histogram) for a particular frame is stored in a memory.

24. The method of claim 9 wherein the predefined control response is stored in the same memory as the analysis data.

25. The method of claim 1 wherein the final blended control response is stored in the same memory as the predefined control response and the analysis data.

26. The method of claim 1 wherein a multiport memory is used.

27. The method of claim 1 wherein a single port memory is used.

28. The method of claim 1 wherein the different data in the same memory are accessed at a different time.

29. The method of claim 1 wherein the final blended control response is regenerated from the predefined control responses on a real time basis (not stored in a memory).

30. Computer program product for controlling a display device comprising:

computer code for automatically and adaptively controlling contrast and color of the device in which user defined contrast control responses are blended using a combination of interpolation and non-linear methods such as thresholding, wherein the final blended control response is stored in a memory or look-up table, and wherein the blended control response is read from the memory during active display time and the analysis data (histogram) and predefined control responses are read during the display inactive time; and computer readable medium for storing the computer code.

31. The computer program product of claim 30, further comprising computer code for analyzing the pixel luma distribution, by collection and analysis of pixel luma distribution using multiple bands; and computer code for generating of a luma and chroma control response.

32. The computer program product of claim 31 in which the multiple bands include overlapping bands.

33. The computer program product of claim 32 further comprising:

computer code for collecting pixel luma distribution information using bin counters for each band.

34. The computer program product of claim 33 wherein the computer code for collecting further comprises computer code that limits the collection of pixel luma distribution information to a user-definable region in the display.

35. The computer program product of claim 30 wherein the application of automatic and adaptive contrast and color control is to a user-definable region in the display.

36. The computer program product of claim 33 in which user definable sensitivity to rate of change of image content is generated by computer code for averaging the collected pixel luma distribution data over a user-defined number of frames.

37. The computer program product of claim 31 wherein the luma and chroma control response is based on user-defined inputs that could be a finite subset of all possible control responses.

38. The computer program product of claim 30 in which the user defined contrast control responses are specified by lookup tables that are specified using base value and incremental slope.

39. The computer program product of claim 38 in which an optimal contrast control response is generated by analysis of the actual luma distribution followed by blending of user defined contrast control responses.

40. The computer program product of claim 30 in which blending weights are generated using relative luma distribution values or generated by scaling the luma band bin counters.

41. The computer program product of claim 40 in which user defined contrast control responses are blended using interpolation and the generated blending weights.

42. The computer program product of claim 30 in which user defined contrast control responses are blended using non-linear methods such as thresholding.

43. The computer program product of claim 30 in which the input pixel dynamic range is mapped to the display or user-defined dynamic range.

44. The computer program product of claim 30 in which the blended luma control response is modified using the minimum input luma value and maximum input luma value.

45. The computer program product of claim 30 in which a chroma adjustment factor is generated based on analysis of the difference between the input luma value and the output luma value, in order to maintain or enhance perceived color saturation.

46. The computer program product of claim 30 in which a non-linear chroma adjustment factor is generated based on analysis of the difference between input luma and output luma.

47. The computer program product of claim 30 in which a chroma adjustment offset is generated that is added to the input chroma value.

48. The computer program product of claim 47 in which RGB, YUV, YCrCb, YPrPb or any other color domain are utilized.

49. The computer program product of claim 30 in which analog or digital displays are utilized.

50. The computer program product of claim 30 in which previous frame luma distribution data during the vertical active interval is collected, and then predicted contrast processing functions are generated for the next image frame during the vertical retrace interval.

51. The computer program product of claim 31 wherein the analysis data (histogram) for a particular frame is stored in a memory.

52. The computer program product of claim 38 wherein the predefined control response is stored in the same memory as the analysis data.

53. The computer program product of claim 30 wherein the final blended control response is stored in the same memory as the predefined control response and the analysis data.

54. The computer program product of claim 30 wherein a multiport memory is used.

55. The computer program product of claim 30 wherein a single port memory is used.

56. The computer program product of claim 30 wherein the different data in the same memory are accessed at a different time.

* * * * *